United States Patent [19]

Simonette

[11] Patent Number: 4,822,194

[45] Date of Patent: Apr. 18, 1989

[54] APPLICATOR HEAD

[75] Inventor: Dallas W. Simonette, Stacy, Minn.

[73] Assignee: Power Flo Products Corp., Minneapolis, Minn.

[21] Appl. No.: 19,770

[22] Filed: Feb. 27, 1987

[51] Int. Cl.[4] ..... A47L 1/08; B05C 17/00

[52] U.S. Cl. ..... 401/207; 401/138; 401/197; 15/144 R

[58] Field of Search ..... 401/207, 197, 203, 204, 401/289, 48, 138, 140, 139, 196, 261, 283; 15/144 R

[56] References Cited

U.S. PATENT DOCUMENTS

| | | | |
|---|---|---|---|
| 1,186,088 | 6/1916 | Finlay | 401/207 |
| 2,350,469 | 6/1944 | Litka | 401/289 |
| 2,557,214 | 6/1951 | Bales | 401/140 |
| 2,647,273 | 8/1953 | Eagle . | |
| 2,685,702 | 8/1954 | Jones | 401/289 |
| 3,000,040 | 9/1961 | Carlson . | |
| 3,020,579 | 2/1962 | O'Connor . | |
| 3,114,922 | 12/1963 | Ballantyne | 401/138 |
| 3,210,794 | 10/1965 | Vosbikian | 401/140 |
| 3,369,268 | 2/1968 | Burns et al. . | |
| 3,713,744 | 1/1973 | Sims | 401/196 X |
| 3,766,879 | 10/1973 | Jones . | |
| 3,776,645 | 12/1973 | Walker . | |
| 4,119,386 | 10/1978 | Cushing | 401/138 |
| 4,291,491 | 9/1981 | Maddock . | |
| 4,357,779 | 11/1982 | Maddock . | |
| 4,611,941 | 9/1986 | Karliner et al. . | |
| 4,639,156 | 1/1987 | Stern et al. | 401/146 |

OTHER PUBLICATIONS

O-Cedar Car Washer, Advertisement 6/1955.

*Primary Examiner*—Richard J. Apley
*Assistant Examiner*—Franklin L. Gubernick
*Attorney, Agent, or Firm*—Peterson, Wicks, Nemer & Kamrath

[57] ABSTRACT

A head for the application of a fluid such as paint to a surface is shown in the most preferred form as a tee fitting which is pivotally mounted to a pad assembly. First and second hoses extend from nipples formed on the manifold base of the pad assembly to tee stems of a tee fitting for providing the dual functions of providing fluid communication therebetween and for placing a torsional spring action between the pad assembly and the applicator pole for placing uniform pressure on the pad to flatly contact the surface. The nipples are in fluid communication with a trough formed in the manifold base corresponding to a removed portion in the fluid impervious backing of the pad. The foam layer of the pad is free of direct fluid communication paths to the flocking such that fluid must flow into and through the foam for even distribution to the flocking in a wicking distribution by capillary action. The foam layer expands in the removed portion and includes a channel located within the removed portion and tributaries extending therefrom for quicker and easier fluid flow into the foam.

20 Claims, 2 Drawing Sheets

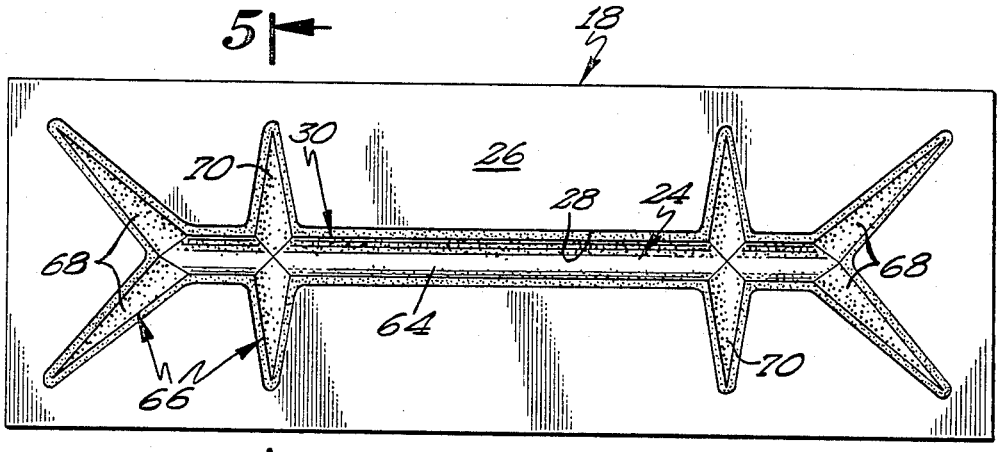
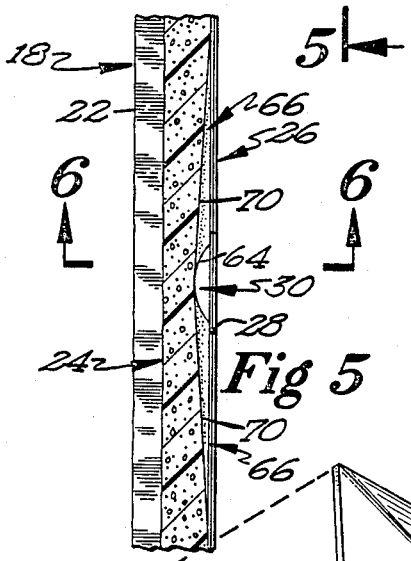
Fig 5
Fig 4
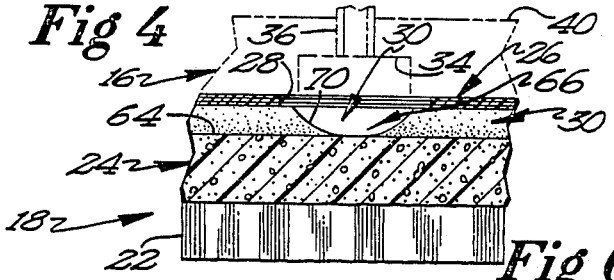
Fig 6
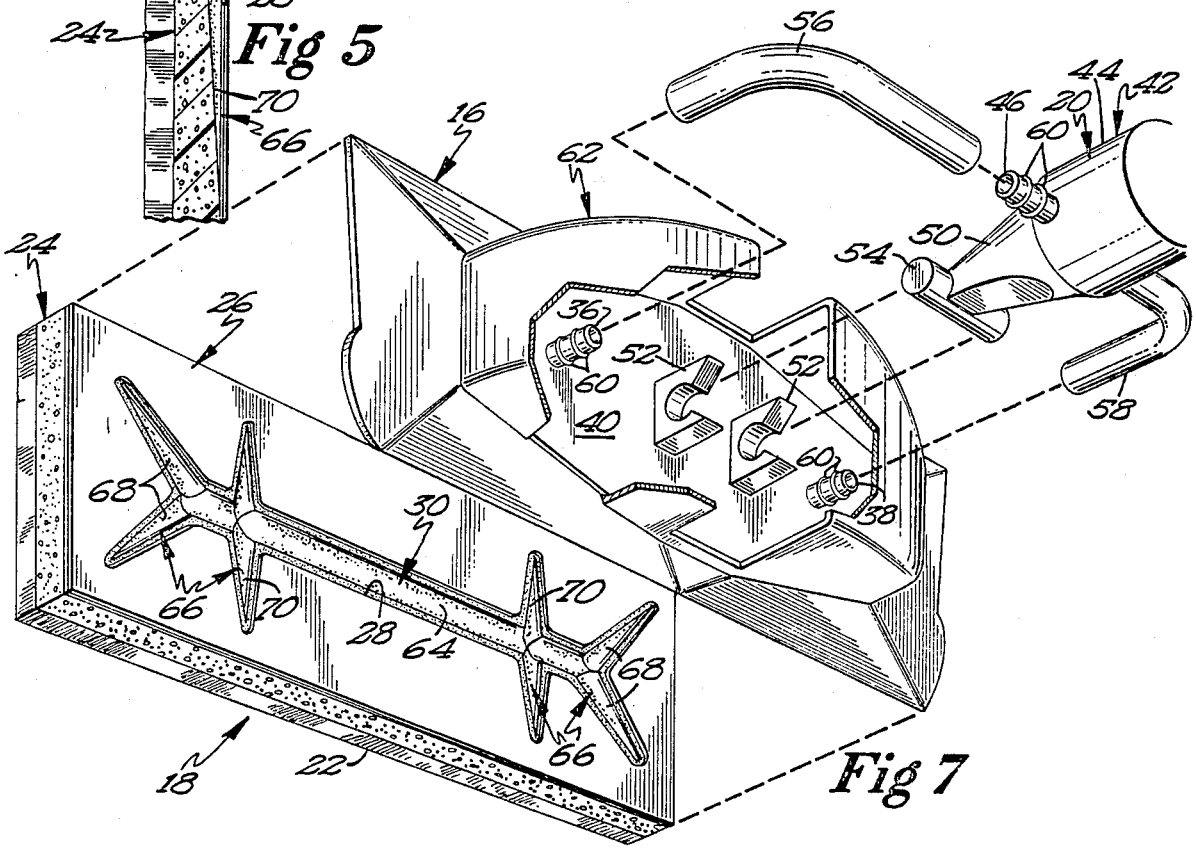
Fig 7

APPLICATOR HEAD

BACKGROUND

The present invention relates generally to heads for applying fluid to a surface, and in the preferred form, an applicator head for applying paint.

In order to enhance the beauty of and protect the surface of various items in his environment, man has applied various protective coatings thereto. Most commonly the coating applied is in the nature of a paint, however numerous other coatings such as shellac, varnish, white wash, or oil finishes are also used in certain instances. When the coating is applied to a large uniform surface, it is necessary that an even layer of the coating be expeditiously applied covering the entire surface with a minimum amount of spillage or spatter to adjacent surfaces. The application of the varying amounts of coating to surfaces often requires the operator to make multiple passes of the applicator head over the surface being coated to produce a uniform film of the coating. When multiple passes are not made to level the coating film, unsightly drips, runs, or "lace-curtains" often result. In addition, the application of an uneven layer of coating causes, in some instances, uneven life of the coating manifested by premature chipping or peeling of the coating from the surface. Multiple passes over the coated surface require increased operator time spent on coating a given surface. The increase in time both decreases the operator's productivity and increases the cost of coating the surface.

The art is replete with various attempts at solutions to the problems inherent in applying solutions to a surface evenly, uniformly, quickly, and easily. However, the known prior art has not been able to effectively overcome the problems in this area.

SUMMARY

The present invention solves these and other problems in the area of the application of fluids to a surface by providing, in a first aspect of the present invention, an applicator head including a pad assembly pivotally mounted to a fluid inlet. Fluid communication and a torsional spring action is provided between the pad assembly and the fluid inlet in the most preferred form by flexible hoses extending in a tight manner therebetween. The hoses return the pad assembly to a free state with respect to the inlet when the pad assembly does not engage the surface and places the pad assembly under uniform pressure to flatly contact the surface independent of the pivotal position of the pad assembly with respect to the inlet.

In another aspect of the present invention, an applicator head is provided including a pad including a layer of foam sandwiched between a fluid impervious backing and a fluid accepting and spreading member. The foam does not include any direct fluid communication paths therethrough. Fluid introduction into the foam for wicking therethrough by capillary action is provided in the most preferred form by a removed portion formed in the backing allowing the foam to expand therethrough as the result of pressurized fluid flow into and through the foam. In the most preferred form, a channel located in the removed portion extends from the top surface of the foam to a depth less than the thickness of the foam to allow quicker and easier fluid flow into the foam.

It is thus an object of the present invention to provide a novel head for the application of a liquid to a surface.

It is further an object of the present invention to provide such a novel applicator head which distributes fluid evenly on the surface.

It is further an object of the present invention to provide such a novel applicator head which is free of direct fluid communication to the surface.

It is further an object of the present invention to provide such a novel applicator head which distributes the fluid evenly throughout the pad.

It is further an object of the present invention to provide such a novel applicator head which produces a uniform fluid texture application.

It is further an object of the present invention to provide such a novel applicator head which utilizes capillary action in the foam of the pad to distribute the fluid evenly throughout the pad.

It is further an object of the present invention to provide such a novel applicator head which allows one pass fluid coverage.

It s further an object of the present invention to provide such a novel applicator head including a pivotal pad assembly which tends not to flip when direction of motion is reversed.

It is further an object of the present invention to provide such a novel applicator head having a torsional spring action placed on a pivotal pad assembly.

It is further an object of the present invention to provide such a novel applicator head which generates uniform pressure on the surface.

It is further an object of the present invention to provide such a novel applicator head including a pivotal pad assembly which returns to a common position every time the head is in its free state.

It is further an object of the present invention to provide such a novel applicator head having reduced number of components due to multifunction components.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 4 shows a back view of a component of the applicator head of FIG. 1 according to view line 4—4 of FIG. 1.

FIG. 5 shows an enlarged cross sectional view of the component of the applicator head of FIG. 4 according to section line 5—5 of FIG. 4.

FIG. 6 shows an enlarged cross sectional view of the component of the applicator head of FIG. 4 according to section line 6—6 of FIG. 5.

FIG. 7 shows an exploded perspective view of the applicator head of FIG. 1.

Figure 1:
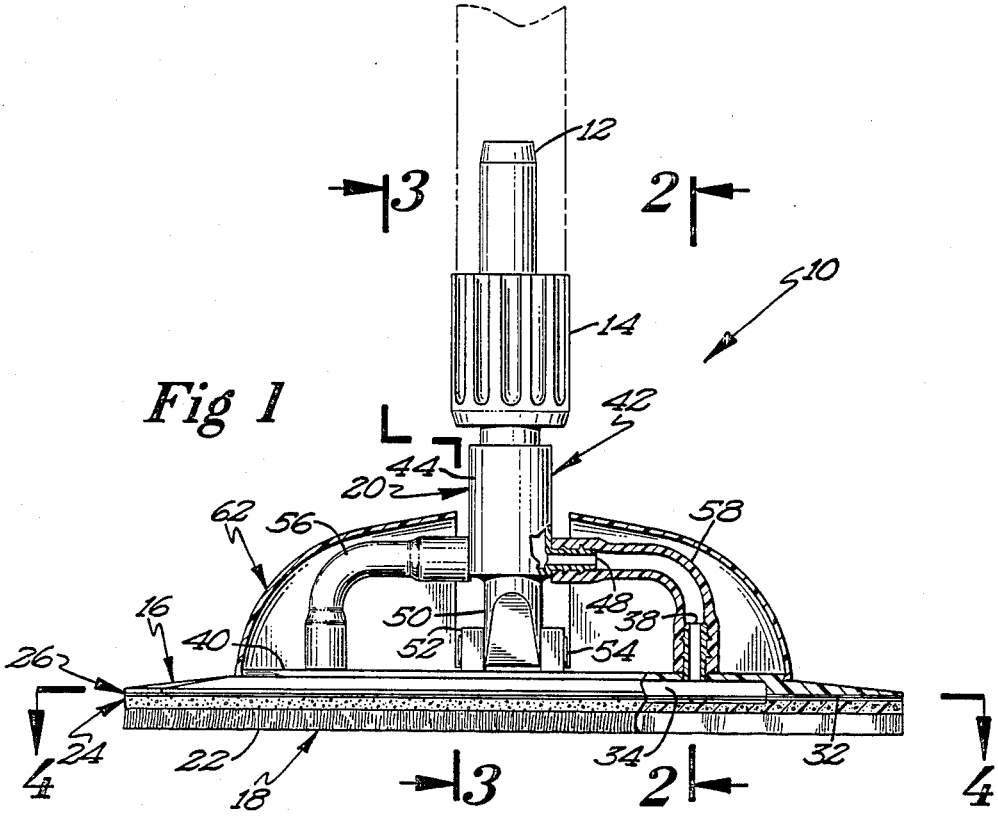
FIG. 1 shows a side elevational view of an applicator head according to the preferred teachings of the present invention with parts broken away for clarity.

All figures are drawn for ease of explanation of the basic teachings of the present invention only; the extensions of the Figure with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "edge", "surface", "inside", "outside", and similar terms are used herein, it should be understood that these terms have reference only to the structure shown in the drawings as it would appear to a person viewing the drawings and are utilized only to facilitate describing the invention.

DESCRIPTION

Figure 2:
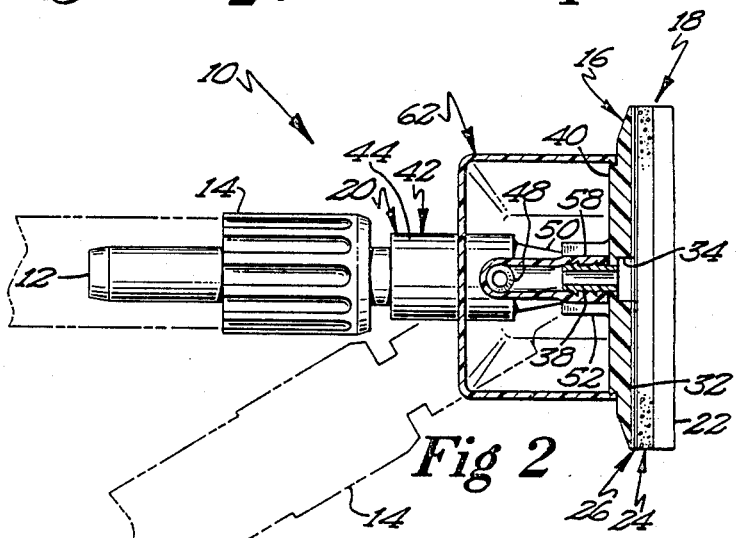
FIG. 2 shows a cross sectional view of the applicator head of FIG. 1 according to section line 2—2 of FIG. 1.
Figure 3:
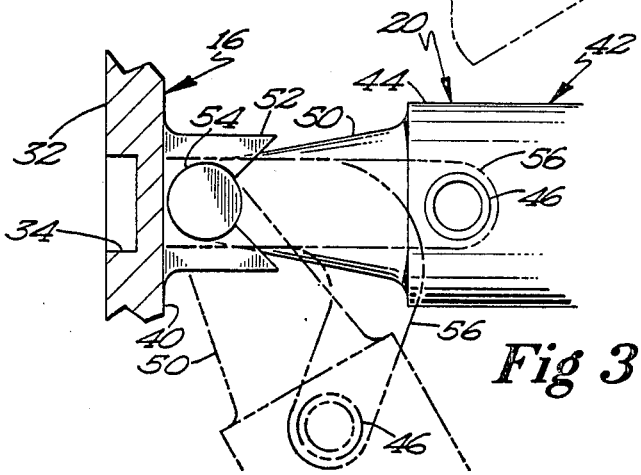
FIG. 3 shows a cross sectional view of applicator head of FIG. 1 according to section line 3—3 of FIG. 1.

A head for applying fluid such as paint to a surface according to the teachings of the present invention is shown in the drawings and generally designated 10. Applicator head 10 generally includes an inlet tube 12 having a cinch nut 14, a manifold base 16, a pad 18 secured to the manifold base 16, and a member 20 for pivotally connecting inlet tube 12 to manifold base 16 and for providing fluid communication from inlet tube 12 to manifold base 16. Inlet tube 12 may be attached to an applicator pole shown in phantom in FIGS. 1 and 2 utilizing cinch nut 14.

Pad 18 in its most preferred form includes a layer of flocking 22 and a layer of foam 24 having a backing 26 secured to manifold base 16. Flocking 22 includes hairs or fibers which accept fluid from foam 24 and spread it evenly over the surface to which the fluid is desired to be applied. Flocking 22 produces a smooth texture for the fluid on the application surface, with the hair or fiber of flocking 22 being of a length and density to follow the application surface and spread the fluid thereon. Foam 24 has a density, hardness, firmness, and thickness for receiving and distributing fluid. Foam 24 includes open cells for allowing passage of fluid therethrough and in the most preferred form is 97% open cell reticulated foam. In its most preferred form, backing 26 is formed of one or more layers of material generally impervious to fluid communication to foam 24.

According to the teachings of the present invention, applicator head 10 includes an advantageous fluid distribution system 30 for pad 18. In its most preferred form, system 30 includes a removed portion 28 located generally intermediate the top and bottom edges of pad 18 and generally equidistant from the side edges of pad 18. Aside from removed portion 28, backing 26 is free of apertures or other fluid communication paths to foam 24.

In its most preferred form, system 30 further includes a longitudinally extending main channel 64 formed in foam 24 and located in removed portion 28. The depth of main channel 64 extends from the surface of foam 24 adjacent to backing portion 26 to a point spaced from the surface of foam 24 adjacent flocking 22 such that main channel 64 does not intersect with the surface of foam 24 adjacent flocking 22. In its most preferred form, main channel 64 has a constant depth along its longitudinal axis in the range of 20% of the thickness of pad 18 and in the range of 30% of foam 24. Further, main channel 64 has a constant width along its longitudinal axis. Thus, main channel 64 of system 30 does not extend through or provide a through passage for fluid through foam 24 to flocking 22.

In the preferred form of the present invention, distribution system 30 further includes tributaries 66 for distributing fluid from main channel 64 throughout the area of foam 24. In the most preferred form, tributaries 66 of system 30 have a depth generally equal to the depth of main channel 64 at their intersection and decrease in depth to a point which is located on the surface of foam 24 adjacent to backing portion 26. Further, tributaries 66 in the most preferred form have a width which decreases from their maximum width at their intersection with main channel 64 to a point at their ends remote from main channel 64. In the most preferred form, tributaries 66 include a pair of legs 68 extending from each end of main channel 64 in a Y configuration, with each leg 68 located at an obtuse angle to the longitudinal axis of main channel 64. Tributaries 66 further include in the most preferred form, two pairs of fingers 70 extending on opposite sides of main channel 64, with each finger 70 extending generally perpendicular to the longitudinal axis of main channel 64. In the preferred form, fingers 70 longitudinally divide main channel 64 into three segments of generally equal distribution areas.

In the preferred form, removed portion 28 of backing 26 has a shape complimentary to main channel 64 and tributaries 66 and a size generally 30% larger than main channel 64 and tributaries 66.

In the preferred form, the bottom surface 32 of manifold base 16 includes a longitudinally extending trough 34 corresponding to and complementary to main channel 64 of pad 18. In its most preferred form, trough 34 has a constant depth and width along its longitudinal axis, with the width being generally equal to but slightly smaller than the width of main channel 64 of pad 18. First and second hose nipples 36 and 38 upstand from the top surface 40 of manifold base 16 and are located equal distances from the opposite side edges and centerline of pad 18. Nipples 36 and 38 are in fluid communication with trough 34 which then directs fluid therefrom in both directions along foam 24 within removed portion 28. In its most preferred form, nipples 36 and 38 are located generally at the intersection of fingers 70 with main channel 64 such that fluid does not have to pass through a 90° turn on the horizontal along pad 18 to enter fingers 70 from nipples 36 and 38.

In its most preferred form, member 20 includes a fluid tee fitting 42 including a main conduit 44 and first and second tee stems 46 and 48 forming a generally T-shape. Main conduit 44 has a shape and size for fluid communication with inlet tube 12 and in the most preferred form, inlet tube 12 is snap fit within main conduit 44. Inlet tube 12 may include an abutment shoulder to prevent removal of cinch nut 14 therefrom after interconnection to main conduit 44 of tee fitting 42. Thus, main conduit 44 receives incoming fluid from inlet tube 12 and divides it into two equal amounts for passage through tee stems 46 and 48.

Member 20 according to the teachings of the present invention further includes a pivot extension 50 pivotally connected to and between pivot ears 52 by a pivot pin 54. In its most preferred form, pivot extension 50 is formed on and contiguous with main conduit 24 of tee fitting 42 extending coaxially therefrom and perpendicular to tee stems 46 and 48. Pivot ears 52 extend upwardly from top surface 40 centrally of manifold base 16 intermediate nipples 36 and 38 on opposite sides of pivot extension 50. Pivot pin 54 extends between and pivotally mounts pivot extension 50 to and between pivot ears 52 about a pivot axis which is parallel to tee stems 46 and 48 and perpendicular to conduit 44 and nipples 36 and 38. Pivot pin 54 may be a separate part or may be integrally formed with pivot extension 50.

Member 20 according to the teachings of the present invention includes hoses 56 and 58 extending between and fluid interconnecting nipples 36 and 38 with tee stems 46 and 48 for providing fluid communication between main conduit 44 of tee fitting 42 and trough 34 of manifold base 16 and for providing a torsional bias between manifold base 16 and fluid tee fitting 42. Specifically, hoses 56 and 58 are formed of flexible material and have a length to extend in a generally tight, arcuate manner between nipples 36 and 38 and tee stems 46 and 48 such that hoses 56 and 58 must be stretched and kinked from their free state when manifold base 16 is pivoted with respect to inlet tube 12. In its most preferred form, hoses 56 and 58 are formed of clear material to help the operator determine when hoses 56 and 58 are clean when cleaning applicator head 10. Furthermore, it can be appreciated that hoses 56 and 58 must be formed of material compatible to the fluid such as paint being applied as well as the solvents used in cleaning applicator head 10. Provisions 60 such as toothed and straight barbs are provided on nipples 36 and 38 and tee stems 46 and 48 for anchoring and preventing rotation of hoses 56 and 58 with respect thereto and for providing a sealing interconnection therebetween. Provisions 60 may further include hose clamps or similar devices to assist the barbs in preventing hoses 56 and 58 from pulling, twisting and/or rotating with respect to nipples 36 and 38 and tee stems 46 and 48.

Applicator head 10 according to the teachings of the present invention may include a cover 62 for protecting nipples 36 and 38, tee stems 46, and hoses 56 and 58 from damage such as by catching on objects and for improving overall appearance. In its most preferred form, cover 62 has a snap type interconnection with top surface 40 of manifold base 16.

Now that the construction of applicator head 10 according to the teachings of the present invention has been described, the operation and subtle features of the present invention can be set forth and appreciated. First, hoses 56 and 58 perform a dual function, thus reducing the number of parts of applicator head 10 according to the teachings of the present invention and reducing the cost of manufacture and assembly. Specifically, hoses 56 and 58 form a fluid communication path from tee fitting 42 to manifold base 16. However, hoses 56 and 58 according to the teachings of the present invention also place a torsional spring action between manifold base 16 and inlet 12 which is connected to the fluid applicator pole. Specifically, pivoting of manifold base 16 relative to the applicator pole tends to twist hoses 56 and 58 through an angle, to stretch hoses 56 and 58, and also to straighten hoses 56 and 58. Due to their anchoring on nipples 36 and 38 and tee stems 46 and 48, hoses 56 and 58 resist such twisting, stretching, and straightening and tend to return to their normal condition. Further, although the distance between nipples 36 and 38 and tee stems 46 and 48 is fairly constant whatever the pivotal position of the applicator pole relative to manifold base 16 according to the teachings of the present invention, the angle of barbs 60 changes to place tension on hoses 56 and 58 such that hoses 56 and 58 straighten out to an angle greater than 90° and in the range of 100° to 120° when manifold base 16 is off center relative to the applicator pole. It can then be appreciated that the torsional spring force of hoses 56 and 58 can be varied by varying the wall thickness, durometer, length, and material of hoses 56 and 58 utilized.

In the preferred form of the present invention with the central locations of nipples 36 and 38 and pivot ears 52 on top surface 40 of manifold base 16, manifold base 16 will be biased such that surfaces 32 and 40 are generally perpendicular to inlet 12 and the applicator pole in the free state or in other words when the pad assembly does not contact the surface. It should further be realized that during use, it is desired to have pad 18 of applicator head 10 flatly contact the surface to which the fluid is desired to be applied independent of the angle of the applicator pole and manifold base 16 as the operator moves the manifold base 16 up and down or back and forth on the surface. It can then be appreciated that the torsional spring action of hoses 56 and 58 insures that pad 18 of applicator head 10 flatly contacts the surface with uniform pressure independent of the pivotal position of the applicator pole with respect to manifold base 16 and pad 18. This feature is important in the even distribution and texture of the fluid applied to the surface.

The preferred construction of the pivotal attachment of manifold base 16 to inlet 12 and the applicator pole is advantageous according to the teachings of the present invention. Particularly, the pivot axis of manifold base 16 and tee fitting 42 is located as close as possible to top surface 40 of manifold base 16 and thus to flocking 22 to help prevent flipping of the pad assembly including manifold base 16 and pad 18 when direction of motion along the surface is reversed. Particularly, the axis of pivot pin 54 is located less than one inch (2.54 cm) from the surface to which fluid is being applied by the pad assembly during operation of applicator head 10 according to the teachings of the present invention and is located in the range of one half inch (1.27 cm) from the applied surface in the most preferred form of the present invention. This close proximity of the pivot axis insures that the line of force transmitted from the applicator pole to applicator head 10 is adjacent pad 18 such that the transmitted force does not create a torque for the pad assembly to pivot about the pivot axis. Further, the central location of the pivot axis defined by pin 54 between the top and bottom edges of pad 18 generates uniform pressure by pad 18 on the surface to be coated. It should then be noted that the preferred construction of the pivotal attachment utilizes a pin having a relatively small diameter and specifically does not transmit fluid or perform like functions which require larger diameters than in the present invention.

Applicator head 10 according to the teachings of the present invention is further advantageous in the even distribution of fluid throughout pad 18. Particularly, tee fitting 42 equally divides the incoming fluid into two equal amounts. These equal amounts of fluid are carried by tee stems 46 and 48, hoses 56 and 58, and nipples 36 and 38 to trough 34. It can then be appreciated that with manifold base 16 having two distribution points to pad 18, namely through nipples 36 and 38, the fluid has to travel less to reach all locations of pad 18 than if only a single distribution point were provided. Further, the central location of nipples 36 and 38 within two identical size areas of pad 18 further insures that fluid is distributed evenly throughout the area of pad 18.

To further insure even distribution of fluid throughout pad 18, no direct fluid communication paths such as apertures or the like is provided through foam 24 but rather the fluid is forced to travel through foam 24 to reach flocking 22. It should be appreciated that the applicator to which inlet 12 of applicator head 10 is attached places fluid under pressure for delivery to pad 18. This positive pressure forces the fluid to travel into foam 24. Further, foam 24 includes open cells which generates a capillary action to wick the fluid into foam 24 and distribute it evenly throughout foam 24.

It should then be noted that distribution system 30 allows for quicker and easier fluid flow into and through foam 24. Specifically, foam 24 forms passages for the fluid to pass through. As fluid is pressurized, removed portion 28 allows these passages in foam 24 to balloon or expand in cross sectional area like a soft hose allowing more fluid to pass therethrough. As foam 24 expands due to the pressurized fluid, main channel 64 opens to allow fluid flow within channel 64 and into the passages of foam 24 to allow fluid flow quicker and easier into foam 24. It can then be appreciated that trough 34 of manifold base 16 allows fluid distribution along removed portion 28 and main channel 64 of pad 18 and also allows for the expansion of foam 24 through removed portion 28 and beyond bottom surface 32 of manifold base 16. Further, tributaries 66 allow fluid flow away from main channel 64 towards the periphery of pad 18, with fluid being wicked in a capillary action from tributaries 66 and into foam 24 adjacent tributaries 66. Thus, tributaries 66 help to distribute fluid throughout the area of foam 24 such that fluid passage from foam 24 is not concentrated in any one area.

It can then be appreciated that distribution system 30 of applicator head 10 according to the teachings of the present invention forms an irrigation type fluid distribution utilizing step down passages for reducing travel in foam 24 and for helping provide even distribution of the fluid on the applied surface. In particular, fluid is divided from conduit 44 into hoses 56 and 58 for delivery into main channel 64 where it is again divided into tributaries 66. Tributaries 66 have a decreasing size as they extend away from main channel 64 relecting the reduced quantity of fluid as the result of passage of fluid from tributaries 66 along their length. It can then be appreciated that applicator head 10 according to the teachings of the present invention allows a more uniform textured and even distribution of fluid on the surface than in prior applicator heads which allowed fluid communication directly to the flocking through the foam.

Now that the basic teachings of the present invention have been explained, many extensions and variations will be obvious to one having ordinary skill in the art. For example, although applicator head 10 according to the teachings of the present invention has been shown and described in its preferred form as including several advantageous and inventive features and is believed to be particularly advantageous, an applicator head could be constructed according to the teachings of the present invention incorporating further features or fewer features after the teachings of the present invention become known.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An applicator head for applying fluid to a surface comprising, in combination: a pad having a top surface and a bottom surface for evenly distributing fluid onto the surface; a manifold base having a bottom surface and a top surface, with the top surface of the pad being secured adjacent to the bottom surface of the manifold base; a fluid inlet comprising a tee fitting having a conduit and first and second tee stems extending generally perpendicular from the conduit; means for pivotally mounting the fluid inlet to the manifold base about a pivot axis generally perpendicular to the fluid inlet; and means for providing fluid communication between the fluid inlet and the pad and for placing a torsional spring action between the manifold base and the fluid inlet to bias the bottom surface of the manifold base generally perpendicular to the fluid inlet comprising, in combination: a first hose having a first end and a second end; a second hose having a first end and a second end; and first and second nipples extending from the top surface of the manifold base generally perpendicular to the bottom surface of the manifold base and intersecting the pivot axis; means for preventing rotation of the first end of the first hose with respect to the first tee stem of the fluid inlet; means for preventing rotation of the second end of the first hose with respect to the first nipple of the manifold base; means for preventing rotation of the first end of the second hose with respect to the second tee stem of the fluid inlet; and means for preventing rotation of the second end of the second hose with respect to the second nipple of the manifold base, with the first hose being in fluid communication between the first tee stem and the first nipple and with the second hose being in fluid communication between the second tee stem and the second nipple, with the hoses being formed of flexible material and extending in a tight manner between the tee stem and the nipples requiring the hoses to be stretched and kinked from their free state when the manifold base and the fluid inlet are pivoted about the pivot axis.

2. The applicator head of claim 1 wherein the rotation preventing means comprises tooth shaped annular barbs formed on the fluid inlet and the manifold base received in the ends of the hose.

3. The applicator head of claim 1 wherein the manifold base includes a top edge and a bottom edge, with the pivot axis being located equidistant between the top and bottom edges of the manifold base.

4. The applicator head of claim 3 wherein the pivot axis is located as close as possible to the top surface of the manifold base to prevent flipping of the manifold base when direction of motion along the surface is reversed, with the pivot axis being located in the range of one half inch from the bottom surface of the pad.

5. The applicator head of claim 4 wherein the manifold base includes first and second side edges; and wherein the fluid inlet is pivotally mounted to the manifold base equidistant between the side edges of the manifold base.

6. The applicator head of claim 5 wherein the first nipple is located intermediate the top and bottom edges and intermediate the first side edge and the fluid inlet and wherein the second nipple is located intermediate the top and bottom edges and intermediate the second edge and the fluid inlet positioning the nipples in the center of two equal areas to reduce fluid travel.

7. The applicator head of claim 6 wherein the pivotally mounting means comprises, in combination: a pivot extension extending coaxially from the conduit of the tee fitting and perpendicular to the tee stems; ears extending from the top surface of the manifold base; and a pivot pin pivotally connecting the pivot extension to and between the ears, with the pivot axis being parallel to the first and second tee stems and perpendicular to the conduit.

8. The applicator head of claim 1 further comprising, in combination: a cover for receipt on the top surface of the manifold base for protecting and aesthetically covering the tee stem, the hoses, and the nipples.

9. The applicator head of claim 1 wherein the pad comprises, in combination: a layer of foam having a top surface and a bottom surface, with the foam being generally free of direct fluid communication paths between the top and bottom surfaces of the foam; means secured to the bottom surface of the foam for accepting fluid from the foam for spreading over the surface; a backing secured to the top surface of the foam, with the backing being generally impervious to fluid, with the backing being secured to the bottom surface of the manifold base; and means for introducing fluid into the foam for distribution through the foam to the fluid accepting means including a removed portion formed in the backing having an area generally equal to or larger than the area of the fluid communication providing means.

10. The application head of claim 9 further comprising, in combination: a trough formed in the bottom surface of the manifold base having a shape corresponding to the shape of the removed portion of the backing, with the fluid communication providing means terminating in the trough, with the trough allowing for the expansion of the foam through the removed portion and allowing fluid distribution along the removed portion.

11. The applicator head of claim 10 further comprising, in combination: a channel formed in the foam and located in the removed portion, with the channel having a depth less than the thickness of the foam and extending from the top surface of the foam to a point spaced from the bottom surface of the foam to allow quicker and easier fluid flow into the foam.

12. The application head of claim 11 further comprising, in combination: tributaries formed in the foam intersecting with and extending from the channel for distributing fluid from the channel throughout the foam, with the tributaries having a depth less than the thickness of the foam and extending from the top surface of the foam to a point spaced from the bottom surface of the foam, with the size of the tributaries decreasing along the tributaries away from the channel.

13. The applicator head of claim 15 wherein the removed portion has a shape complementary to the channel and the tributaries and has a size generally 30% larger than the channel and the tributaries.

14. The applicator head of claim 1 wherein the manifold base includes a top surface; and wherein the pivot axis is located as close as possible to the top surface of the manifold base to prevent flipping of the manifold base when direction of motion along the surface is reversed, with the pivot axis being located in the range of one half inch from the bottom surface of the pad.

15. An applicator head for applying fluid to a surface comprising, in combination: a pad having a top surface and a bottom surface for evenly distributing fluid onto the surface; a manifold base having a bottom surface, with the top surface of the pad being secured adjacent to the bottom surface of the manifold base; a fluid inlet; means for pivotally mounting the fluid inlet to the manifold base about a pivot axis generally perpendicular to the fluid inlet; and means for providing fluid communication between the fluid inlet and the pad and for placing a torsional spring action between the manifold base and the fluid inlet to bias the bottom surface of the manifold base generally perpendicular to the fluid inlet; and wherein the pad comprises, in combination: a layer of foam having a top surface and a bottom surface, with the foam being generally free of direct fluid communication paths between the top and bottom surfaces of the foam; means secured to the bottom surface of the foam for accepting fluid from the foam for spreading over the surface; a backing secured to the top surface of the foam, with the backing being generally impervious to fluid, with the backing being secured to the bottom surface of the manifold base; and means for introducing fluid into the foam for wicking therethrough for even distribution through the foam to the fluid accepting means including means allowing the foam to expand through the backing as the result of fluid flow into and through the foam.

16. An applicator head for applying fluid to a surface comprising, in combination: a pad comprising, in combination: a layer of foam having a top surface and a bottom surface, with the foam being generally free of direct fluid communication paths between the top and bottom surfaces of the foam; means secured to the bottom surface of the foam for accepting fluid from the foam for spreading over the surface; a backing secured to the top surface of the foam, with the backing being generally impervious to fluid; a manifold base having a bottom surface, with the backing being secured to the bottom surface of the manifold base; means for providing fluid communication to the bottom surface of the manifold base; and means for introducing fluid into the foam for wicking therethrough for distribution through the foam to the fluid accepting means, with the fluid introducing means including means allowing the foam to expand through the backing as the result of fluid flow into and through the foam.

17. An applicator head for applying fluid to a surface comprising, in combination: a pad comprising, in combination: a layer of foam having a top surface and a bottom surface, with the foam being generally free of direct fluid communication paths between the top and bottom surfaces of the foam; means secured to the bottom surface of the foam for accepting fluid from the foam for spreading over the surface; a backing secured to the top surface of the foam, with the backing being generally impervious to fluid; a manifold base having a bottom surface, with the backing being secured to the bottom surface of the manifold base; means for providing fluid communication to the bottom surface of the manifold base; means for introducing fluid onto the foam for wicking therethrough for distribution through the foam to the fluid accepting means, with the fluid introducing means including a removed portion formed in the backing having an area generally equal to or larger than the area of the fluid communication providing means; and a trough formed in the bottom surface of the manifold base having a shape corresponding to the shape of the removed portion of the backing, with the fluid communication providing means terminating in the trough, with the trough allowing for the expansion of the foam through the removed portion and allowing fluid distribution along the removed portion.

18. The applicator head of claim 17 further comprising, in combination: a channel formed in the foam and located in the removed portion, with the channel having a depth less than the thickness of the foam and extending from the top surface of the foam to a point spaced from the bottom surface of the foam to allow quicker and easier fluid flow into the foam.

19. The applicator head of claim 18 further comprising, in combination: tributaries formed in the foam intersecting with and extending from the channel for distributing fluid from the channel throughout the foam, with the tributaries having a depth less than the thickness of the foam and extending from the top surface of the foam to a point spaced from the bottom surface of the foam, with the size of the tributaries decreasing along the tributaries away from the channel.

20. The applicator head of claim 19 wherein the removed portion has a shape complementary to the channel and the tributaries and has a size generally 30% larger than the channel and the tributaries.

* * * * *

UNITED STATES PATENT OFFICE

CERTIFICATE OF CORRECTION

Patent No. 4,822,194 Dated April 18, 1989

Inventor(s) Dallas W. Simonette

It is certified that error appears in the above-identified patent and that said Letters Patent is hereby corrected as shown below:

Column 2, line 22, cancel "s" and substitute therefor --is--.
Column 3, line 1, cancel "Figure" and substitute therefor --Figures--.
Column 8, line 26, cancel "and" (second occurrence).
Column 8, line 44, cancel "stem" and substitute therefor --stems--.
Column 9, line 18, cancel "stem" and substitute therefor --stems--.
Column 9, line 58, cancel "15" and substitute therefor --12--.
Column 10, line 61, cancel "onto" and substitute therefor --into--.

Signed and Sealed this

Twenty-eighth Day of November 1989

*Attest:*

JEFFREY M. SAMUELS

*Attesting Officer* *Acting Commissioner of Patents and Trademarks*